US010229780B2

(12) United States Patent
Takagi et al.

(10) Patent No.: US 10,229,780 B2
(45) Date of Patent: Mar. 12, 2019

(54) PULSE TRANSFORMER

(71) Applicant: TDK CORPORATION, Tokyo (JP)

(72) Inventors: Nobuo Takagi, Tokyo (JP); Setu Tsuchida, Yamagata (JP); Tasuku Mikogami, Tokyo (JP)

(73) Assignee: TDK CORPORATION, Tokyo (JP)

( * ) Notice: Subject to any disclaimer, the term of this patent is extended or adjusted under 35 U.S.C. 154(b) by 214 days.

(21) Appl. No.: 14/224,556

(22) Filed: Mar. 25, 2014

(65) Prior Publication Data

US 2014/0292464 A1 Oct. 2, 2014

(30) Foreign Application Priority Data

Mar. 27, 2013 (JP) ..... 2013-066275

(51) Int. Cl.

| | |
|---|---|
| ***H01F 27/29*** | (2006.01) |
| ***H01F 17/04*** | (2006.01) |
| ***H01F 27/30*** | (2006.01) |
| *H01F 3/10* | (2006.01) |
| *H01F 27/28* | (2006.01) |

(52) U.S. Cl.

CPC ..... *H01F 27/29* (2013.01); *H01F 27/292* (2013.01); *H01F 3/10* (2013.01); *H01F 27/2828* (2013.01)

(58) Field of Classification Search

None

See application file for complete search history.

(56) References Cited

U.S. PATENT DOCUMENTS

| | | | | |
|---|---|---|---|---|
| 6,373,366 | B1 * | 4/2002 | Sato | H01F 17/045 336/192 |
| 8,093,980 | B2 * | 1/2012 | Asou | H01F 17/045 336/192 |
| 2006/0267719 | A1 * | 11/2006 | Yasuda | H01F 17/045 336/223 |
| 2010/0109827 | A1 | 5/2010 | Asou et al. | |

FOREIGN PATENT DOCUMENTS

| | | |
|---|---|---|
| JP | 2003-197432 | 7/2003 |
| JP | 2003-198728 | 7/2003 |
| JP | 2006-066616 | 3/2006 |
| JP | 2008-021878 | 1/2008 |
| JP | 2009-302321 | 12/2009 |
| JP | 2010-109267 | 5/2010 |

OTHER PUBLICATIONS

U.S. Appl. No. 14/224,581, filed Mar. 25, 2014, by Takagi et al.

* cited by examiner

*Primary Examiner* — Ronald Hinson

(74) *Attorney, Agent, or Firm* — Greenblum & Bernstein, P.L.C.

(57) ABSTRACT

A pulse transformer is provided with a drum core including a winding core and first and second flanges, and wires wound around the winding core. First terminal electrodes and a second center tap are provided on the first flange, and second terminal electrodes and a first center tap are provided on the second flange. Each end of the wires is connected to a corresponding one of the first terminal electrodes, the second center tap, the second terminal electrodes, and the first center tap. A length of the drum core in the X direction is equal to a length of the drum core in the Y direction, so that the shape of the mounting region on the printed circuit board is not changed even after being rotated by 90°.

6 Claims, 14 Drawing Sheets

PULSE TRANSFORMER

BACKGROUND OF THE INVENTION

Field of the Invention

The present invention relates to a pulse transformer and, more particularly, to a surface-mount pulse transformer using a drum-type core.

Description of Related Art

In recent years, in a circuit component such as a connecter, a pulse transformer is widely used for isolating a differential signal at an input side (primary side) and a differential signal at an output side (secondary side). In order to mount a plurality of pulse transformers on a printed circuit board at high density, it is preferable to use a surface-mount pulse transformer using a drum core (see Japanese Patent Application Laid-Open Nos. 2009-302321 and 2010-109267).

A pulse transformer described in the Japanese Patent Application Laid-Open No. 2010-109267 has a configuration in which primary-side terminal electrodes and a secondary-side center tap are formed in one flange, and secondary-side terminal electrodes and a primary-side center tap are formed in the other flange. When a plurality of pulse transformers each having such a configuration are to be mounted on a printed circuit board, there is a need to devise a layout so that withstand voltage between the primary and secondary sides is sufficiently ensured.

FIG. 11A is an exemplary plan view illustrating a state where a common type pulse transformers 11 and 12 are arranged in an X-direction, and FIG. 11B is an exemplary plan view illustrating wiring patterns on a printed circuit board corresponding to the arrangement illustrated in FIG. 11A.

The pulse transformers 11 and 12 illustrated in FIG. 11A have the same shape and structure, and they each have a rectangular shape in a plan view, in which a length in a Y-direction is longer than a length in the X-direction. Symbols P1 and N1 given in FIG. 11A denote a pair of primary-side terminal electrodes, and symbols P2 and N2 denote a pair of secondary-side terminal electrodes. Further, a symbol CT1 denotes a primary-side center tap, and a symbol CT2 denotes a secondary-side center tap. FIG. 11A illustrates the pulse transformers 11 and 12 as viewed from above and transparently illustrates the terminal electrodes positioned at a bottom surface side.

As illustrated in FIG. 11A, the primary-side terminal electrodes P1 and N1 and secondary-side center tap CT2 are disposed in one flange 21, and the secondary-side terminal electrodes P2 and N2 and primary-side center tap CT1 are disposed in the other flange 22. In the flange 21, the primary-side terminal electrode N1 is distanced from the secondary-side center tap CT2 so as to ensure withstand voltage between the primary and secondary sides. Similarly, in the flange 22, the secondary-side terminal electrode P2 is distanced from the primary-side center tap CT1.

When the thus configured pulse transformers 11 and 12 are arranged close to each other in the X-direction, wiring patterns on the printed circuit board have a layout illustrated in FIG. 11B. In FIG. 11B symbols each having a suffix "a" are land patterns to be connected to their corresponding terminal electrodes, and symbols each having a suffix "b" are wiring patterns extending from their corresponding land patterns. Symbols 11R and 12R denote mounted regions of the pulse transformers 11 and 12, respectively.

When the pulse transformers 11 and 12 are arranged close to each other in the X-direction as illustrated in FIG. 11A, a distance between the primary-side terminal electrode P1 of the pulse transformer 11 and secondary-side center tap CT2 of the pulse transformer 12 and a distance between the primary-side center tap CT1 of the pulse transformer 11 and secondary-side terminal electrode N2 of the pulse transformer 12 become very small. Accordingly, as illustrated in FIG. 11B, a distance between the land patterns P1*a* and CT2*a*, a distance between the land patterns N2*a* and CT1*a*, a distance between the wiring patterns P1*b* and CT2*b*, and a distance between the wiring patterns N2*b* and CT1*b* become small, making it difficult to ensure sufficient withstand voltage. Typically, in a circuit component of such a type, a clearance to be ensured between the primary side and secondary side is prescribed in the specification, so that a layout illustrated in FIG. 11B is likely to fail to satisfy the specification.

To avoid such a problem, a distance Dx between the two pulse transformers 11 and 12 in the X-direction is increased to some extent, as illustrated in FIG. 12A. As a result, as illustrated in FIG. 12B, the distance between the wiring patterns P1*b* and CT2*b*, and distance between the wiring patterns CT1*b* and N2*b* can sufficiently be ensured. In this case, however, a region R1 on the printed circuit board becomes a dead space, decreasing use efficiency of the printed circuit board.

Further, as illustrated in FIG. 13A, there can be considered a method in which positions of the flanges 21 and 22 in the configuration illustrated in FIG. 11A or FIG. 12A are interchanged with each other in one pulse transformer. With this configuration, as illustrated in FIG. 13B, the primary sides (or secondary sides) of the two pulse transformers 11 and 12 are adjacently disposed, allowing sufficient withstand voltage to be ensured between the primary and secondary sides. In this case, however, as illustrated in FIG. 13B, a lead-out direction of the primary wiring pattern (P1*b* and N1*b*) in the pulse transformer 11 differs from a lead-out direction of the primary wiring pattern (P1*b* and N1*b*) in the pulse transformer 12 and, similarly, a lead-out direction of the secondary primary wiring pattern (P2*b* and N2*b*) in the pulse transformer 11 differs from a lead-out direction of the secondary wiring pattern (P2*b* and N2*b*) in the pulse transformer 12. Specifically, in the pulse transformer 11 at a left side of FIG. 13B, the primary wiring pattern (P1*b* and N1*b*) and the secondary wiring pattern (P2*b* and N2*b*) are led out downward and upward, respectively; while in the pulse transformer 12 at a right side of FIG. 13B, the primary wiring pattern (P1*b* and N1*b*) and the secondary wiring pattern (P2*b* and N2*b*) are led out upward and downward, respectively. Thus, a routing distance of the wiring patterns on the printed circuit board is disadvantageously increased, and there is a possibility that a difference in characteristics occurs between a signal passing through the pulse transformer 11 and a signal passing through the pulse transformer 12.

Furthermore, there can be considered a method in which the pulse transformer 12 is two-dimensionally rotated at 90° as illustrated in FIG. 14A. With this configuration, as illustrated in FIG. 14B, the primary sides (or secondary sides) of the two pulse transformers 11 and 12 can be adjacently disposed while the lead-out direction of the primary wiring patterns P1*b* and N1*b* can be the same between the pulse transformers 11 and 12, and the lead-out direction of the secondary primary wiring patterns P2*b* and N2*b* can be the same between the pulse transformers 11 and 12. In this case, although a distance between the primary-side center tap CT1 of the pulse transformer 11 and secondary center tap CT2 of the pulse transformer 12 becomes small, this does not pose a big problem in a case where the center taps CT1 and CT2 have the same potential (e.g., the same ground potential). In this case, however, a region R2 on the printed circuit board becomes a dead space, decreasing use efficiency of the printed circuit board.

As described above, when a common type pulse transformer having a rectangular shape in a plan view is used, it is difficult to efficiently lay out the plurality of pulse transformers on the printed circuit board while ensuring sufficient withstand voltage between the primary and secondary sides. Therefore, when the common type pulse transformer is used, freedom of layout on the printed circuit board is restricted.

SUMMARY

An object of the present invention is therefore to provide a pulse transformer capable of ensuring sufficient freedom of layout on the printed circuit board while ensuring sufficient withstand voltage between the primary and secondary sides even when the plurality of pulse transformers are arranged close to each other on the printed circuit board.

To solve the above problem, a pulse transformer according to an aspect of the present invention includes a drum core having a winding core, a first flange provided at one end of the winding core in a first direction, a second flange provided at the other end of the winding core in the first direction; a first terminal electrode, a second terminal electrode, and a second center tap which are provided in the first flange and arranged in a second direction perpendicular to the first direction; a third terminal electrode, a fourth terminal electrode, and a first center tap which are provided in the second flange and arranged in the second direction; a first wire wound around the winding core and having one end connected to the first terminal electrode and the other end connected to the first center tap; a second wire wound around the winding core and having one end connected to the second terminal electrode and the other end connected to the first center tap; a third wire wound around the winding core and having one end connected to the third terminal electrode and the other end connected to the second center tap; and a fourth wire wound around the winding core and having one end connected to the fourth terminal electrode and the other end connected to the second center tap, wherein a length of the drum core in the first direction and a length of the drum core in the second direction are substantially equal to each other.

According to the present invention, the pulse transformer has a square shape in a plan view, so that even when a mounting direction of the pulse transformer is rotated by 90°, a shape of amounting region of the pulse transformer on a printed circuit board is not changed. Thus, freedom of layout on the printed circuit board can be increased.

The pulse transformer according to the present invention further preferably includes a plate core provided so as to contact the first and second flanges, and the plate core preferably has a square outer shape as viewed from a direction perpendicular to the first and second directions. With this configuration, a closed magnetic path is formed by the plate core, allowing high magnetic characteristics to be obtained.

In the present invention, a first distance between the second terminal electrode and second center tap in the second direction is preferably larger than a second distance between the first terminal electrode and second terminal electrode in the second direction, and a third distance between the third terminal electrode and first center tap in the second direction is preferably larger than a fourth distance between the third terminal electrode and fourth terminal electrode in the second direction. With this configuration, it is possible to ensure sufficient withstand voltage between primary and secondary sides.

In the present invention, the second center tap preferably comprises a single terminal electrode provided on the first flange, and the first center tap preferably comprises a single terminal electrode provided on the second flange. This reduces the number of terminal electrodes to be provided in one flange to three, allowing a reduction in size in the second direction.

In the present invention, the second center tap preferably includes first and second center tap terminal electrodes provided in the first flange, and the first center tap preferably includes third and fourth center tap terminal electrodes provided in the second flange. This eliminates the need to connect a plurality of wires to one terminal electrode, which may increase reliability depending on a manufacturing process.

In this case, preferably, the first wire connects the first terminal electrode and third center tap terminal electrode, the second wire connects the second terminal electrode and fourth center tap terminal electrode, the third wire connects the third terminal electrode and first center tap terminal electrode, and fourth wire connects the second terminal electrode and second center tap terminal electrode. With this configuration, by short-circuiting the first and second center tap terminal electrodes on the printed circuit board and short-circuiting the third and fourth center tap terminal electrodes on the printed circuit board, function of a pulse transformer can be obtained.

In the present invention, the first to fourth terminal electrodes and first and second center taps are each preferably formed as a terminal fitting fixed to the first or second flange. This eliminates a process of burning the terminal electrode into the flange, allowing a reduction in manufacturing cost.

As described above, the use of the pulse transformer according to the present invention increases freedom of layout on the printed circuit board. Thus, it is possible to mount a plurality of pulse transformer at high density while ensuring sufficient withstand voltage between the primary and secondary sides.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

Figure 1:
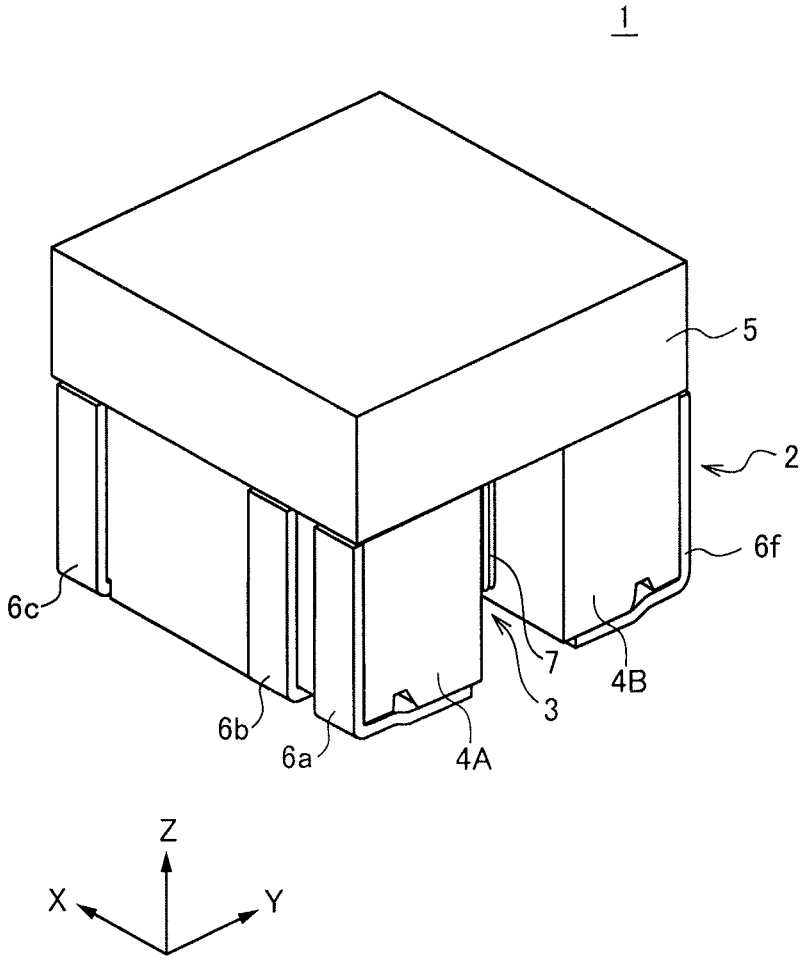
FIG. 1 is a schematic perspective view illustrating an outer appearance of a pulse transformer 1 according to a preferred embodiment of the present invention.
Figure 2:
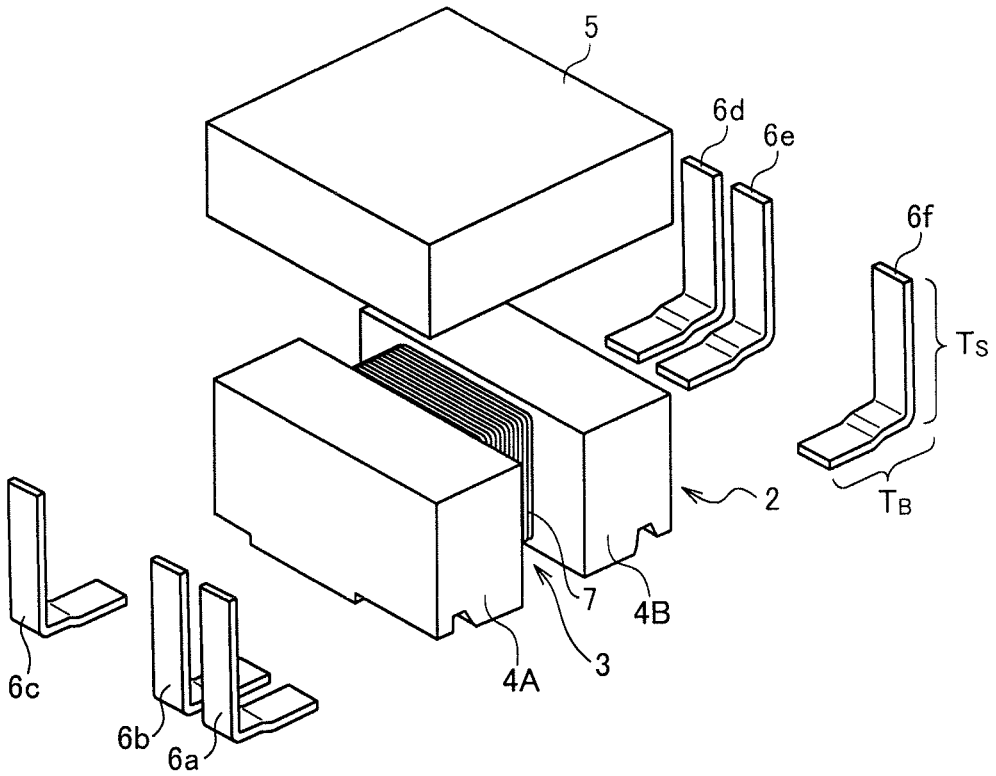
FIG. 2 is an exploded perspective view of the pulse transformer 1 according to the present embodiment.

FIG. 1 is a schematic perspective view illustrating an outer appearance of a pulse transformer 1 according to a preferred embodiment of the present invention. FIG. 2 is an exploded perspective view of the pulse transformer 1 according to the present embodiment, and FIG. 3 is a schematic perspective view of the pulse transformer 1 set with the top and bottom thereof reversed and viewed from the bottom side.

Figure 3:
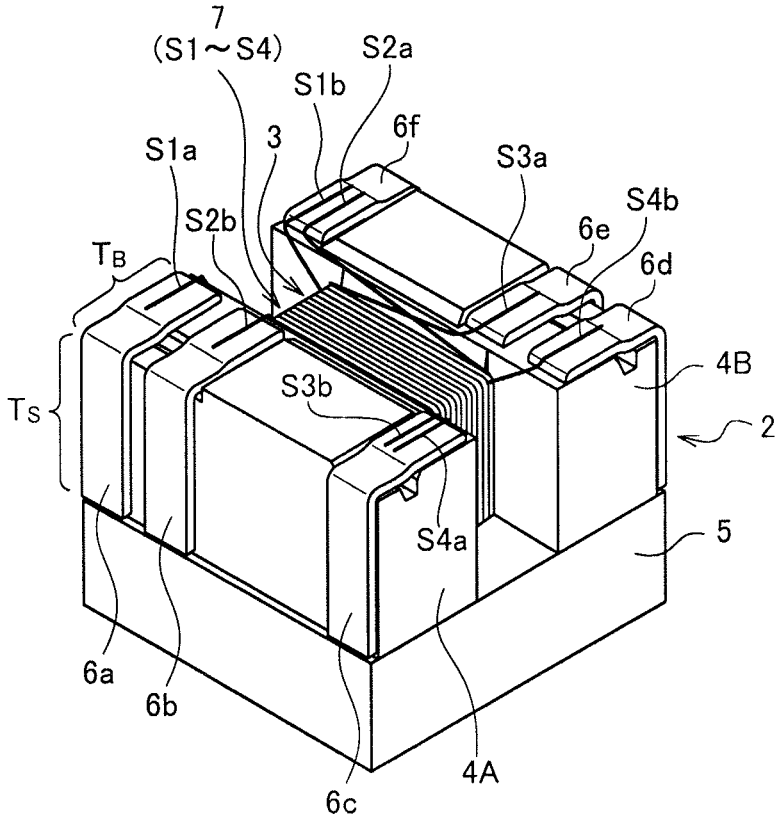
FIG. 3 is a schematic perspective view of the pulse transformer 1 set with the top and bottom thereof reversed and viewed from the bottom side.

As illustrated in FIGS. 1 to 3, the pulse transformer 1 according to the present embodiment includes a drum core 2, a plate core 5, six terminal fittings 6*a* to 6*f*, and a coil 7 having a wire wound around the drum core 2. Although not especially limited, the pulse transformer 1 has a size of about 3.3 mm (X-direction)×about 3.3 mm (Y-direction)×about 2.7 mm (Z-direction). Thus, a planar shape of the pulse transformer 1 as viewed in the Z-direction is a square.

The drum core 2 is formed of a magnetic material such as an Ni—Zn-based ferrite and includes a winding core 3 around which the coil 7 is wound and a pair of flanges 4A and 4B disposed at both ends of the winding core 3 in the Y-direction. The plate core 5 is also formed of a magnetic material such as Ni—Zn-based ferrite and placed and fixed by adhesive onto upper surfaces of the flanges 4A and 4B. A planar shape of the plate core 5 as viewed in the Z-direction is also a square.

An upper surface of the plate core 5 is a flat smooth surface, and thus mounting of the pulse transformer 1 can be achieved using the flat smooth surface as an absorption surface. Preferably, a surface of the plate core 5 to be adhered to upper surfaces of the respective flanges 4A and 4B is also a flat smooth surface. Abutment of the flat smooth surface of the plate core 5 against the flanges 4A and 4B allows tight adhesion between the plate core 5 and flanges 4A, 4B, thereby forming a closed magnetic path free from magnetic flux leakage.

Each of the terminal fittings 6*a* to 6*f* are an L-shaped metal piece extending from a bottom surface of the flange 4A or 4B to an outside side surface thereof. The outside side surface of the flange refers to a surface positioned at an opposite side to a coupling surface of the winding core 3. Preferably, the terminal fittings 6*a* to 6*f* are parts cut out from a lead frame obtained from a single metal piece. The terminal fittings 6*a* to 6*f* are adhered and fixed to the drum core 2 in a state before being cut out from the lead frame and then cut out from a frame part of the lead frame, whereby independent terminal fittings are obtained. The use of the terminal fittings 6*a* to 6*f* is advantageous over the use of a plating electrode in easiness of forming thereof and is thus also advantageous in manufacturing cost. Further, attachment position accuracy of the terminal fittings 6*a* to 6*f* can be enhanced.

Of six terminal fittings 6*a* to 6*f*, three terminal fittings 6*a*, 6*b*, and 6*c* are provided on the flange 4A side, and remaining three terminal fittings 6*d*, 6*e*, and 6*f* are provided on the flange 4B side. The terminal fittings 6*a*, 6*b*, and 6*c* are arranged in the X-direction on the flange 4A, and the terminal fittings 6*d*, 6*e*, and 6*f* are arranged in the X-direction on the flange 4B.

Of three terminal fittings 6*a*, 6*b*, and 6*c*, two terminal fittings 6*a* and 6*b* are provided near one end (in FIG. 2, near a right end) of the flange 4A in the X-direction, and one terminal fitting 6*c* is provided near the other end (in FIG. 2, near a left end) of the flange 4A in the X-direction. That is, a distance between the terminal fittings 6*b* and 6*c* is larger than a distance between the terminal fittings 6*a* and 6*b*, thereby ensuring withstand voltage between the primary and secondary sides. Similarly, of three terminal fittings 6*d*, 6*e*, and 6*f*, two terminal fittings 6*d* and 6*e* are provided near one end (in FIG. 2, near a left end) of the flange 4B in the X-direction, and one terminal fitting 6*f* is provided near the other end (in FIG. 2, near a right end) of the flange 4B in the X-direction. That is, a distance between the terminal fittings 6*e* and 6*f* is larger than a distance between the terminal fittings 6*d* and 6*e*, thereby ensuring withstand voltage between the primary and secondary sides.

As illustrated in FIG. 2, each of the L-shaped terminal fittings 6*a* to 6*f* have a bottom portion $T_B$ contacting the bottom surface of the flange 4A or 4B and a side surface portion $T_s$ contacting the outside side surface of the flange 4A or 4B. As illustrated in FIG. 3, each end of the coil 7 is thermal compression bonded to a corresponding surface of the bottom portion $T_B$ of the terminal fittings 6*a* to 6*f*.

The coil 7 has four wires S1 to S4. The wires S1 to S4 are coated wires and wound around the winding core 3 in a two-layer structure. More in detail, the wires S1 and S4 are wound by bifilar winding to constitute a first layer, and the wires S2 and S3 are wound by bifilar winding to constitute a second layer. The wires S1 to S4 have the same number of turns.

The first layer (wires S1 and S4) and second layer (wires S2 and S3) have different winding directions. That is, when viewing the winding direction, e.g., from the flange 4A toward the flange 4B is viewed from the flange 4A side, the winding direction of the wires S1 and S4 is clockwise, while the winding direction of the wires S2 and S3 is counter clockwise. This configuration is to avoid extending each wire from one end of the winding core 3 to the other end thereof at the start and end of winding.

Connection between the wires S1 to S4 and terminal fittings 6*a* to 6*f* will be described. One end S1*a* of the wire S1 and the other end S1*b* thereof are connected to the terminal fittings 6*a* and 6*f*, respectively, and one end S2*a* of the wire S2 and the other end S2*b* thereof are connected to the terminal fittings 6*f* and 6*b*, respectively. Further, one end S1*a* of the wire S3 and the other end S3*b* thereof are connected to the terminal fittings 6*e* and 6*c*, respectively, and one end S4*a* of the wire S4 and the other end S4*b* thereof are connected to the terminal fittings 6*c* and 6*d*, respectively.

Figure 4:
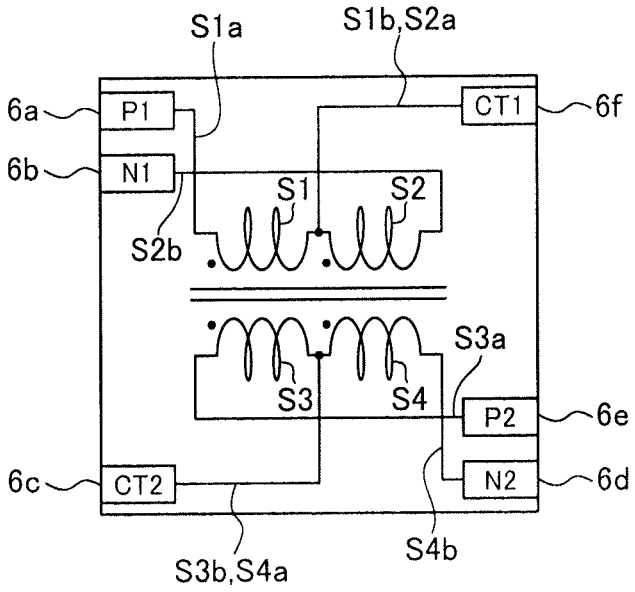
FIG. 4 is an equivalent circuit diagram of the pulse transformer 1.

FIG. 4 is an equivalent circuit diagram of the pulse transformer 1.

As illustrated in FIG. 4, the terminal fittings 6*a* and 6*b* are used as a pair of balanced inputs, that is, a primary-side positive-side terminal electrode P1 and a primary-side negative-side terminal electrode N1, respectively. The terminal fittings 6*e* and 6*d* are used as a pair of balanced outputs, that is, a secondary-side positive-side terminal electrode P2 and a secondary-side negative-side terminal electrode N2, respectively. The terminal fittings 6*c* and 6*f* are used as an input-side center tap CT1 and an output-side center tap CT2, respectively. The wires S1 and S2 constitute a primary winding of the pulse transformer, and the wires S3 and S4 constitute a secondary winding of the pulse transformer. Note that, a signal input/output to/from the pulse transformer is a differential signal, so terms "positive-side" and "negative-side" are used for the purpose of descriptive convenience only. Therefore, the terms "positive-side" and "negative-side" do not mean a fixed potential difference, but for descriptive convenience only, a side at which one differential signal is input/output is referred to "positive-side" and a side at which the other differential signal is input/output is referred to as "negative-side".

Figure 5:
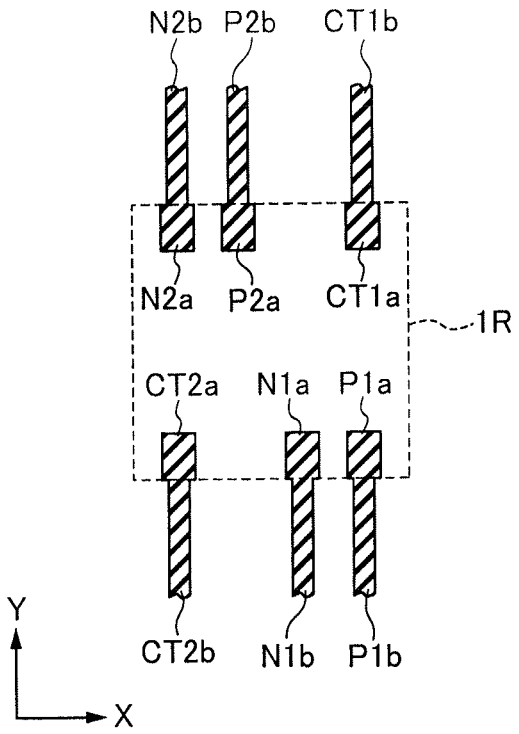
FIG. 5 illustrates only the mounting region 1R corresponding to one pulse transformer 1.

FIG. 5 is a schematic plan view illustrating wiring patterns on the printed circuit board on which the pulse transformer 1 is mounted.

A symbol 1R given in FIG. 5 denotes a mounting region of the pulse transformer 1, and the mounting region R1 has a square shape corresponding to the planer shape of the pulse transformer 1 according to the present embodiment. In a state where the pulse transformer 1 is mounted on the mounting region R1, the primary-side terminal electrodes P1 and N1 are connected to land patterns P1*a* and N1*a*, respectively, and secondary-side terminal electrodes P2 and N2 are connected to land patterns P2*a* and N2*a*, respectively. The center taps CT1 and CT2 are connected to land patterns CT1*a* and CT2*a*, respectively. Wiring patterns P1*b* and N1*b* are led out downward in the figure from the land patterns P1*a* and N1*a*, respectively, and wiring patterns P2*b* and N2*b* are led out upward in the figure from the land patterns P2*a* and N2*a*, respectively. Wiring patterns CT1*b* and CT2*b* are led out from the land patterns CT1*a* and CT2*a*.

FIG. 5 illustrates only the mounting region 1R corresponding to one pulse transformer 1. In a case where two or more pulse transformers 1 are mounted on the printed circuit board, it is necessary to arrange the plurality of mounting regions 1R close to each other. In this case, it is necessary to lay out the mounting regions 1R considering withstand voltage between the primary and secondary sides in respective different pulse transformers for the reason as described above.

Figure 11A:
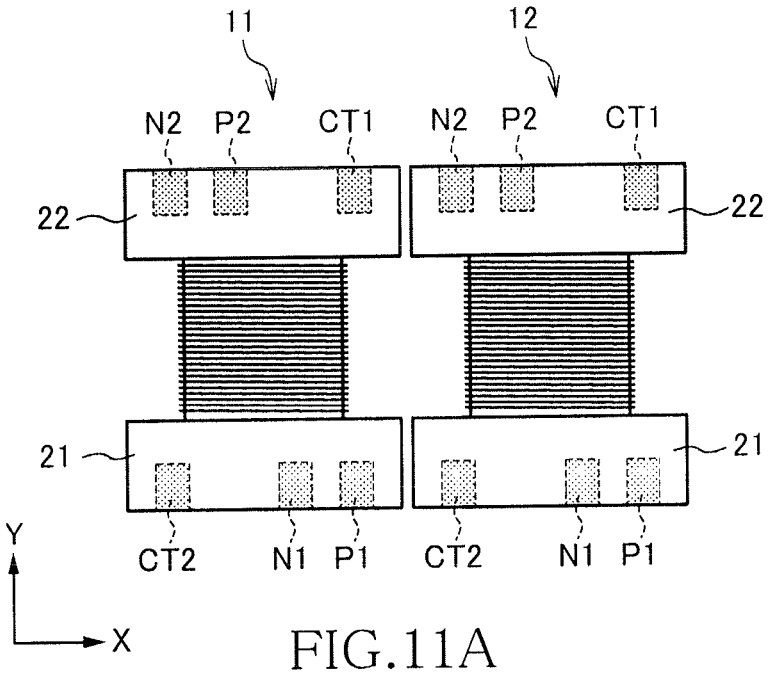
FIG. 11A is an exemplary plan view illustrating a state where a common type pulse transformers 11 and 12 are arranged in an X-direction.
Figure 11B:
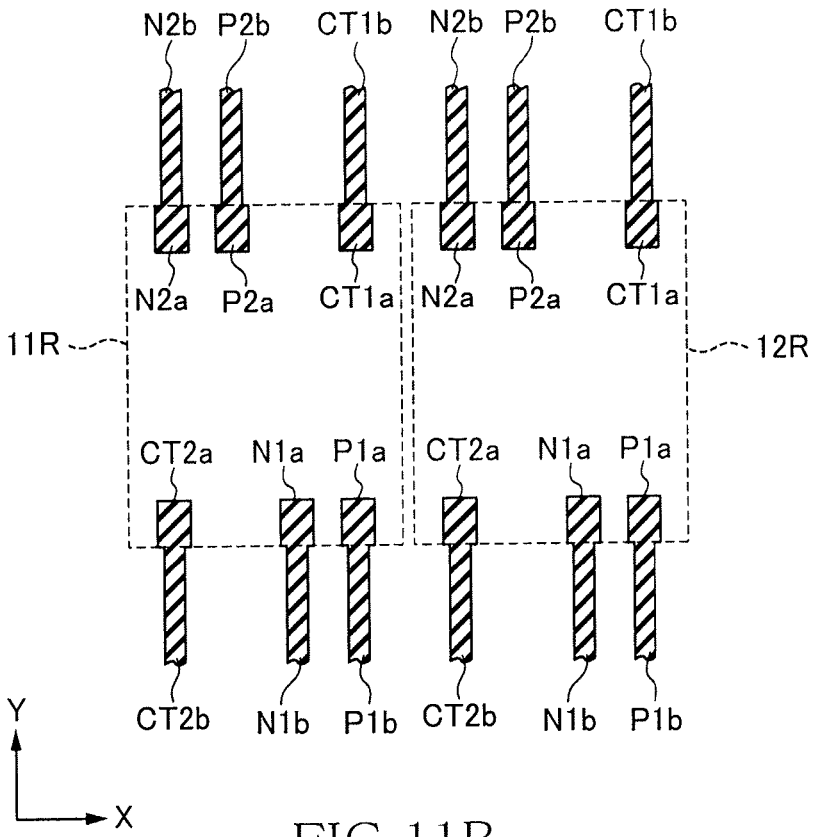
FIG. 11B is an exemplary plan view illustrating wiring patterns on a printed circuit board corresponding to the arrangement illustrated in FIG. 11A.
Figure 12A:
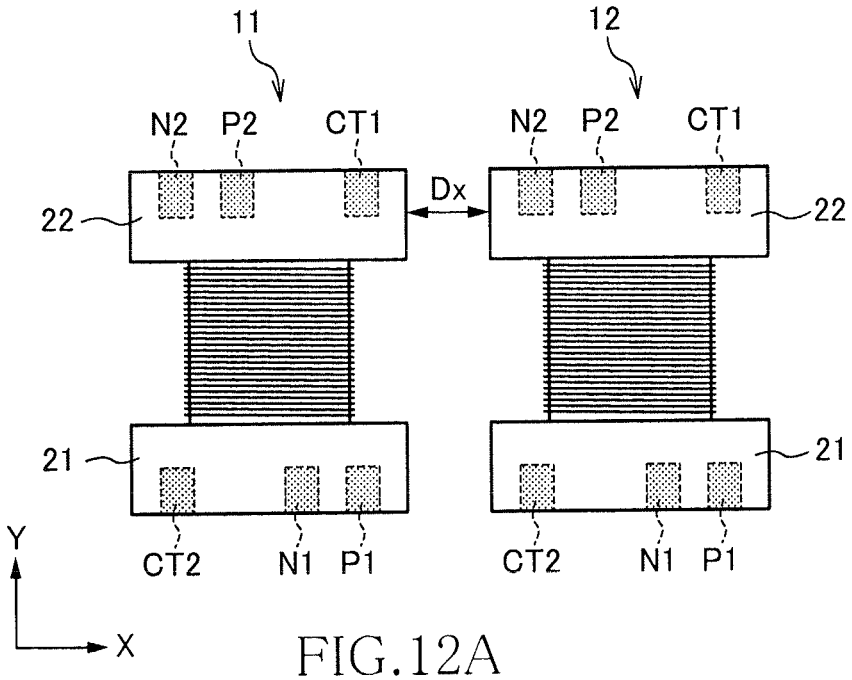
FIG. 12A is an exemplary plan view illustrating a state where a common type pulse transformers 11 and 12 are arranged at a distance Dx in an X-direction.
Figure 12B:
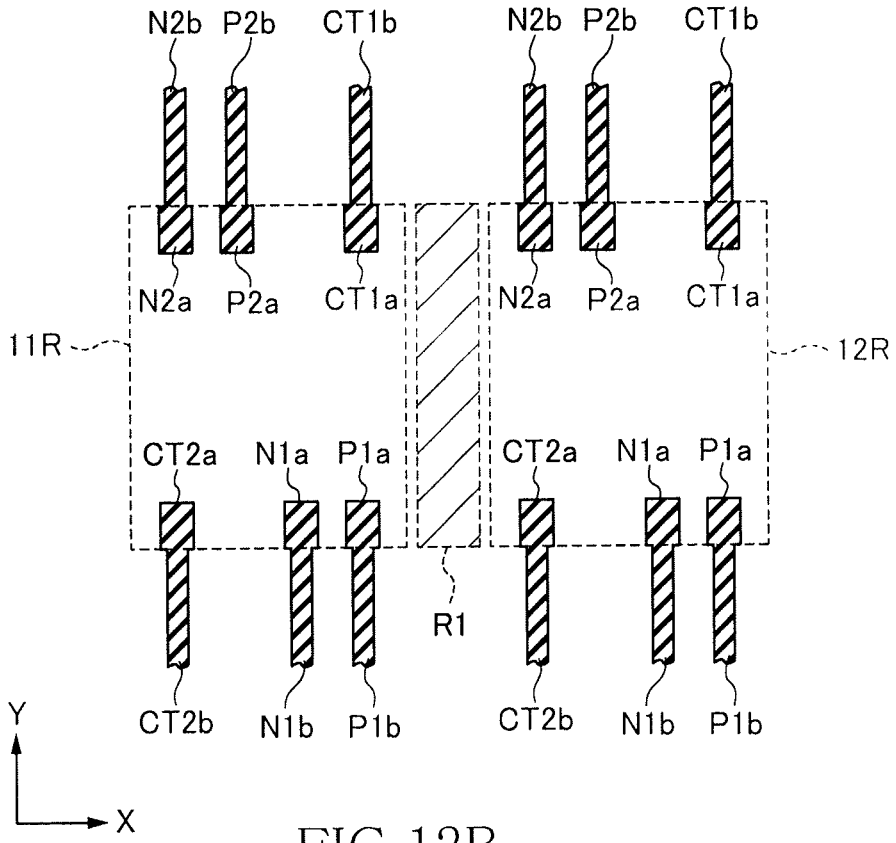
FIG. 12B is an exemplary plan view illustrating wiring patterns on a printed circuit board corresponding to the arrangement illustrated in FIG. 12A.
Figure 13A:
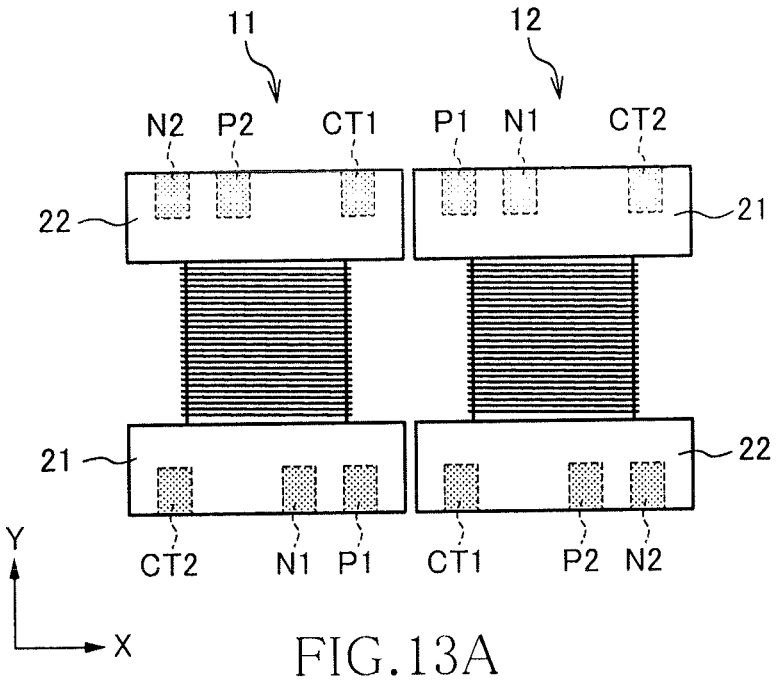
FIG. 13A is an exemplary plan view illustrating a state where a common type pulse transformers 11 and 12 are arranged in an X-direction and the pulse transformer 12 is rotated at 180°.
Figure 13B:
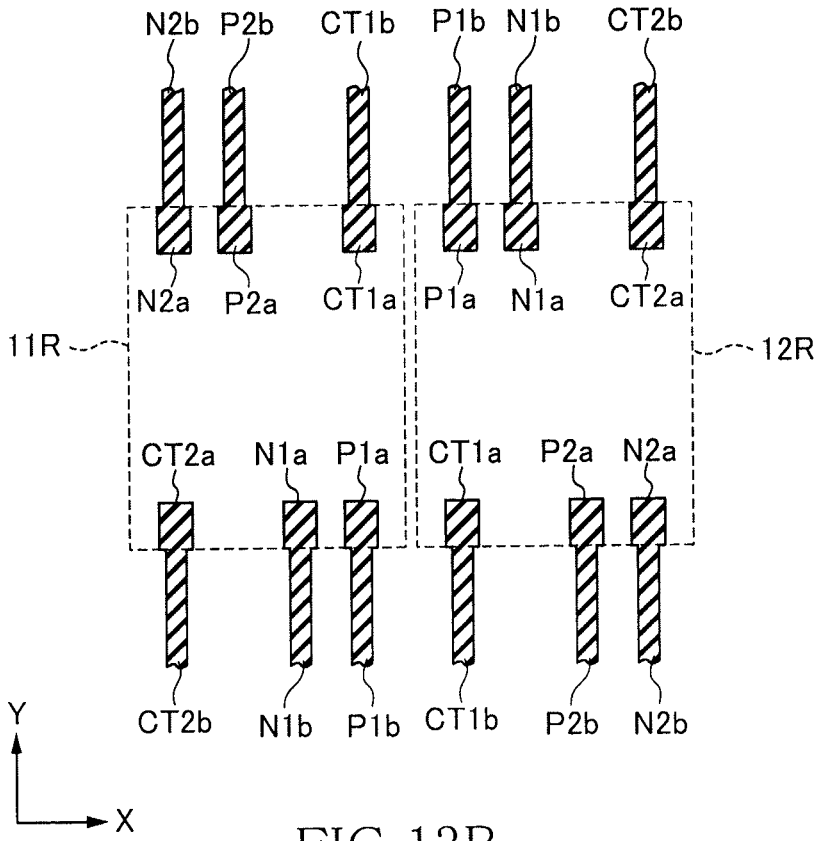
FIG. 13B is an exemplary plan view illustrating wiring patterns on a printed circuit board corresponding to the arrangement illustrated in FIG. 13A.

For example, as described above using FIGS. 11A and 11B, when two pulse transformers 1 are arranged close to each other in the X-direction, the primary side of one pulse transformer 1 and secondary side of the other pulse transformer 1 come close to each other, which may decrease the withstand voltage. To prevent this, as described above using FIGS. 12A and 12B, a distance between the two pulse transformers should be increased; in this case, however, a dead space occurs in the printed circuit board. Further, as described above using FIGS. 13A and 13B, sufficient withstand voltage can be ensured by rotating one transformer in the configuration illustrated in FIG. 12A by 180° to reverse the positions of the primary and secondary sides between the two pulse transformers; in this case, however, the length of the wiring patterns wired on the printed circuit board is disadvantageously increased.

However, as described below, the use of the pulse transformer 1 according to the present embodiment can minimize occurrence of the dead space while ensuring withstand voltage between the primary and secondary sides.

Figure 6A:
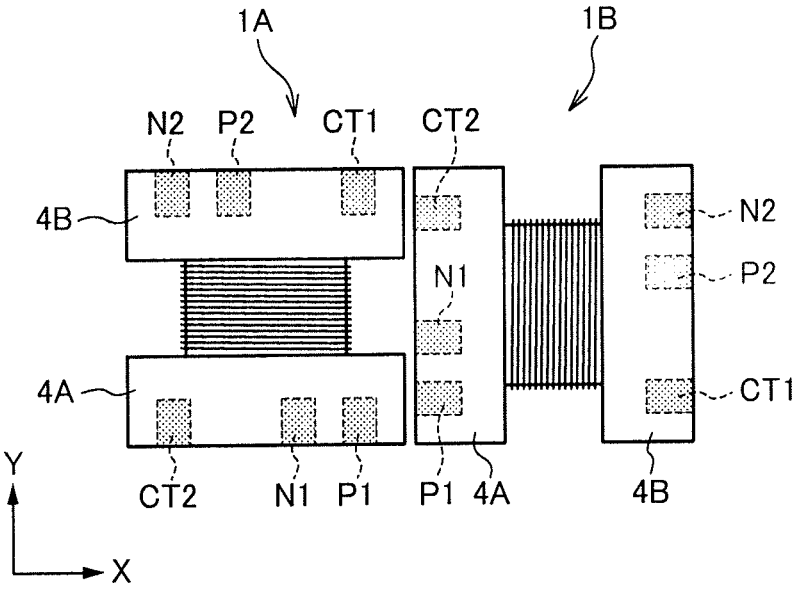
FIG. 6A is an exemplary plan view illustrating a state where two pulse transformers 1A and 1B are arranged in a row in the X-direction.
Figure 6B:
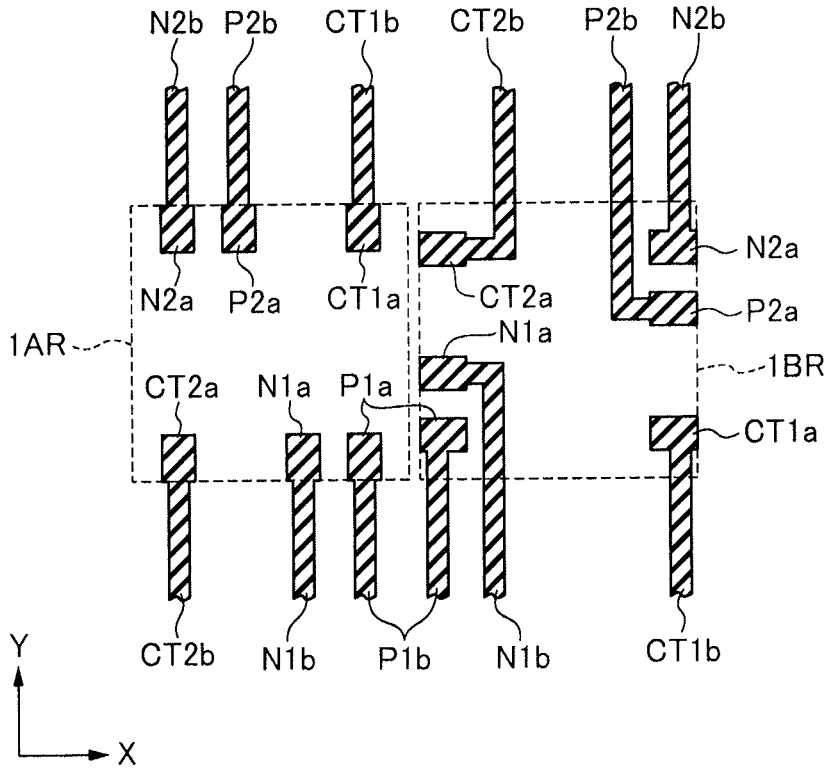
FIG. 6B is an exemplary plan view illustrating wiring patterns on the printed circuit board corresponding to the arrangement illustrated in FIG. 6A.

FIG. 6A is an exemplary plan view illustrating a state where two pulse transformers 1A and 1B are arranged in a row in the X-direction, and FIG. 6B is an exemplary plan view illustrating wiring patterns on the printed circuit board corresponding to the arrangement illustrated in FIG. 6A. The pulse transformers 1A and 1B have the same structure as those of the pulse transformers 1 of FIGS. 1 to 3. Symbols 1AR and 1BR given in FIG. 6B are mounting regions of the pulse transformers 1A and 1B, respectively.

Figure 14A:
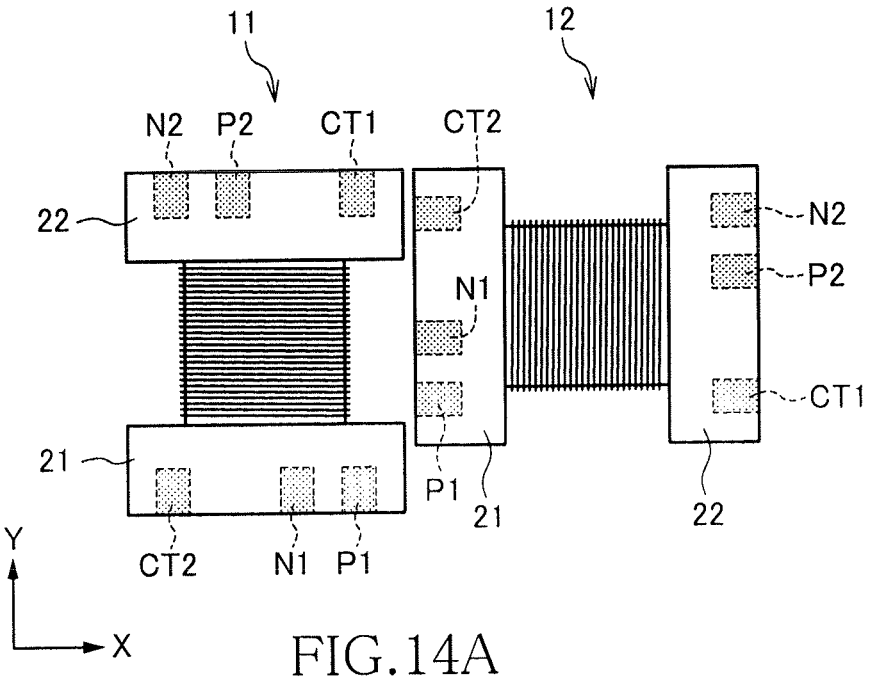
FIG. 14A is an exemplary plan view illustrating a state where a common type pulse transformers 11 and 12 are arranged in an X-direction and the pulse transformer 12 is rotated at 90°.

In the example illustrated in FIG. 6A, mounting directions of the pulse transformers 1A and 1B are different from each other by 90° in a plan view. That is, a mounting method illustrated in FIG. 6A is the same as that illustrated in FIG. 14A. However, the pulse transformer 1 according to the present embodiment has a square shape in a plan view, so that the shape of the mounting region on the printed circuit board is not changed even after being rotated by 90°. That is, the mounting regions 1AR and 1BR have the same shape.

Figure 14B:
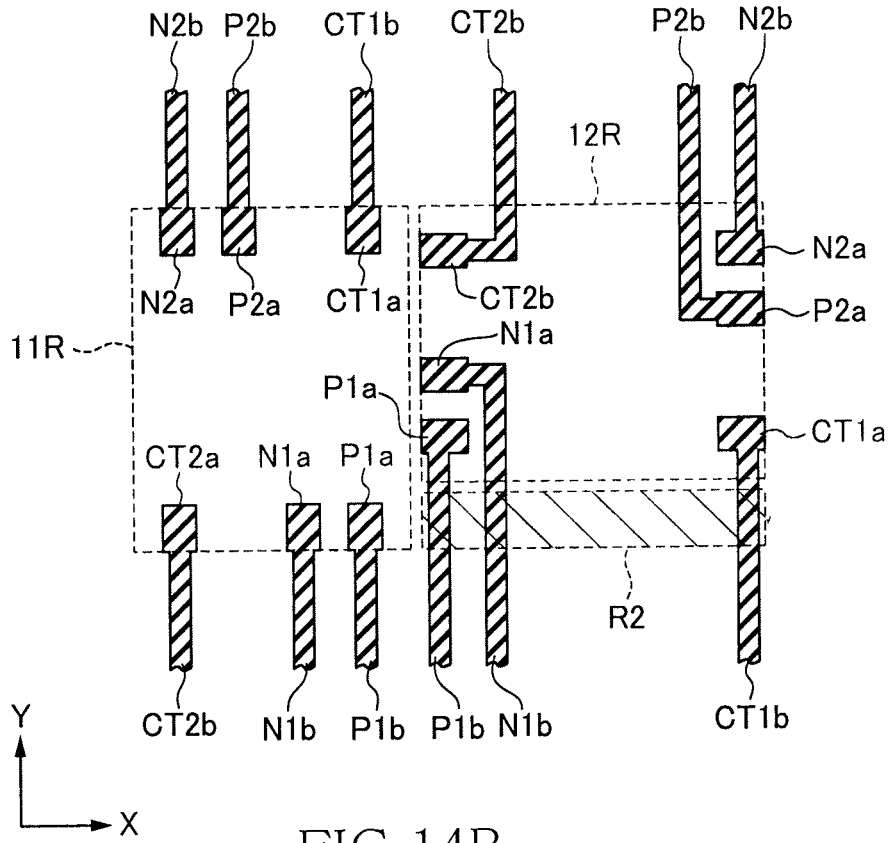
FIG. 14B is an exemplary plan view illustrating wiring patterns on a printed circuit board corresponding to the arrangement illustrated in FIG. 14A.

Thus, the dead space as illustrated in FIG. 14B does not occur, thereby making effective use of a surface of the printed circuit board. Further, as illustrated in FIG. 6B, the primary sides of the two pulse transformers 1A and 1B can be adjacently disposed while the lead-out direction of the primary wiring patterns P1*b* and N1*b* can be the same between the pulse transformers 1A and 1B, and the lead-out direction of the secondary primary wiring patterns P2*b* and N2*b* can be the same between the pulse transformers 1A and 1B. In this case, a distance between the primary-side center tap CT1 of the pulse transformer 1A and secondary center tap CT2 of the pulse transformer 1B becomes small, so that it is necessary to provide a distance between the pulse transformers 1A and 1B in the X-direction to some extent according to need; however, in a case where the center taps CT1 and CT2 have the same potential (e.g., the same ground potential), the distance between the center taps does not pose a big problem. Thus, in such a case, the distance between the pulse transformers 1A and 1B in the X-direction can be made less than the distance Dx in FIG. 12A.

Figure 7A:
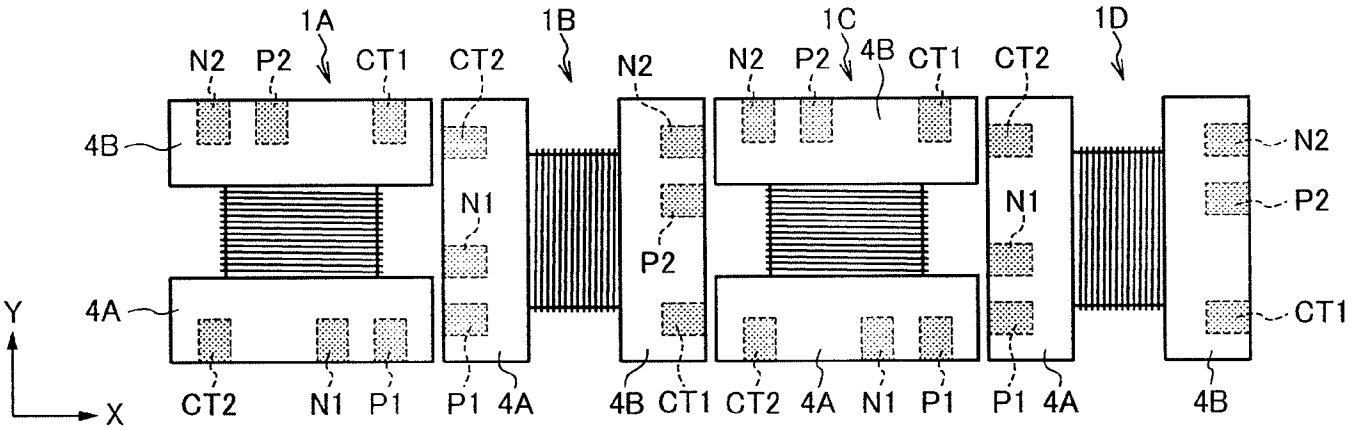
FIG. 7A is an exemplary plan view illustrating a state where four pulse transformers 1A to 1D are arranged in a row in the X-direction.
Figure 7B:
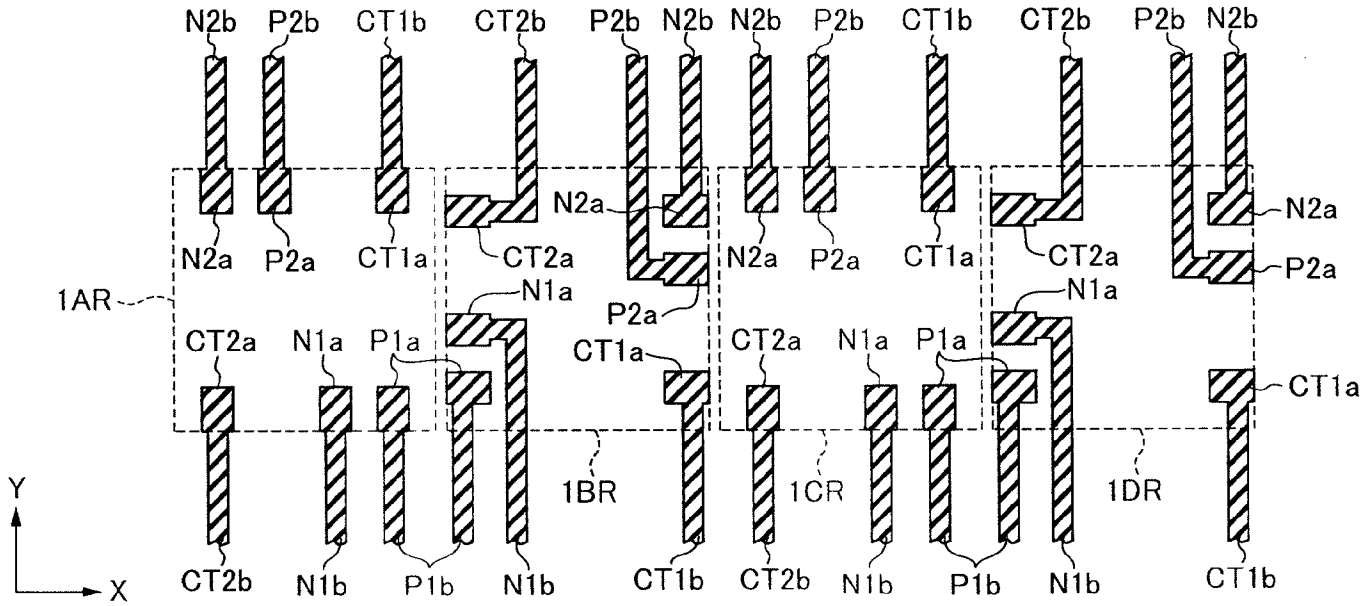
FIG. 7B is an exemplary plan view illustrating wiring patterns on the printed circuit board corresponding to the arrangement illustrated in FIG. 7A.

FIG. 7A is an exemplary plan view illustrating a state where four pulse transformers 1A to 1D are arranged in a row in the X-direction, and FIG. 7B is an exemplary plan view illustrating wiring patterns on the printed circuit board corresponding to the arrangement illustrated in FIG. 7A. The pulse transformers 1A to 1D have the same structure as that of the pulse transformers of FIGS. 1 to 3. Symbols 1AR to 1DR given in FIG. 7B are mounting regions of the pulse transformers 1A to 1D, respectively.

As illustrated in FIG. 7A, the four pulse transformers 1A to 1D are alternately rotated by 90°. That is, assuming that the mounting direction of odd-number pulse transformers 1A and 10 is 0°, the mounting direction of even-number transformers 1B and 1D is rotated by 90°. With this arrangement, as illustrated in FIG. 7B, a layout in which the primary sides are adjacently disposed for the pulse transformers 1A and 1B, the secondary sides are adjacently disposed for the pulse transformers 1B and 1C, the primary sides are adjacently disposed for the pulse transformers 1C and 1D . . . , can be realized, thereby ensuring sufficient withstand voltage between the primary and secondary sides wile preventing occurrence of the dead space.

The mounting method illustrated in FIG. 7A can be applied also to a case where five or more pulse transformers 1 are mounted on the printed circuit board. That is, assuming that the mounting direction of odd-number pulse transformers 1 is 0°, the mounting direction of even-number transformers 1 is rotated by 90°.

However, the layout to be used for the case where the plurality of pulse transformers 1 according to the present embodiment are mounted on the printed circuit board is not limited to those illustrated in FIGS. 6A and 7A, but various other layouts can be adopted.

Figure 8A:
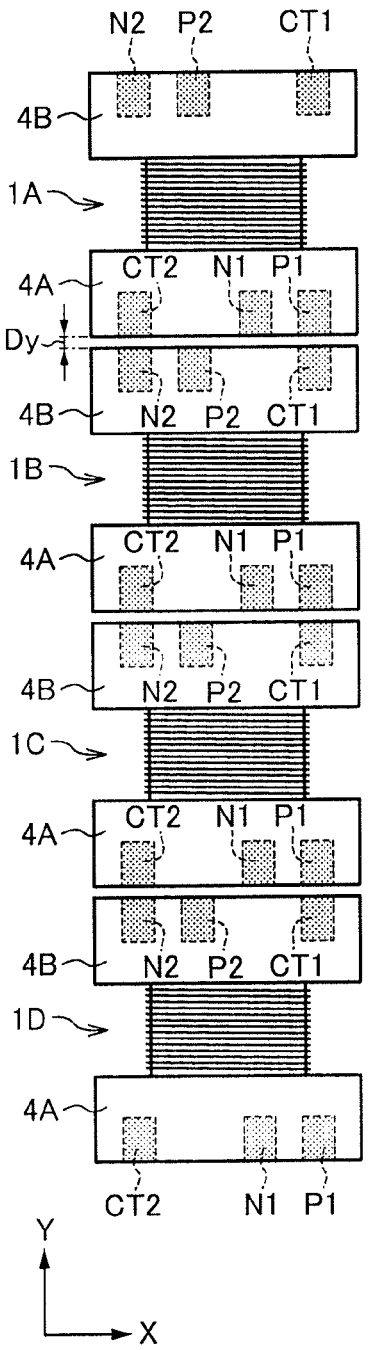
FIG. 8A is an exemplary plan view illustrating a state where the four pulse transformers 1A to 1D are arranged in a row in the Y-direction.
Figure 8B:
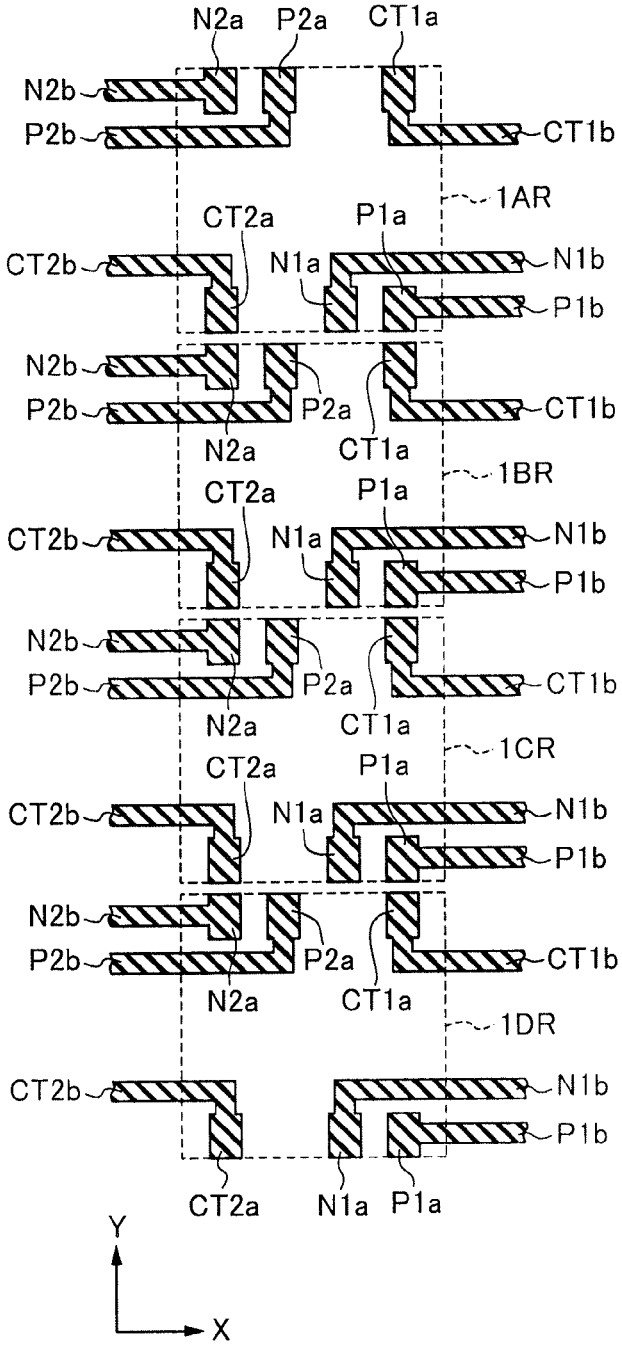
FIG. 8B is an exemplary plan view illustrating wiring patterns on the printed circuit board corresponding to the arrangement illustrated in FIG. 8A.

FIG. 8A is an exemplary plan view illustrating a state where the four pulse transformers 1A to 1D are arranged in a row in the Y-direction, and FIG. 8B is an exemplary plan view illustrating wiring patterns on the printed circuit board corresponding to the arrangement illustrated in FIG. 8A.

As illustrated in FIG. 8A, when the four pulse transformers 1A to 1D are arranged in a row in the Y-direction, it is possible to reduce a distance Dy between the adjacent pulse transformers in the Y-direction. This is because even when the two pulse transformers 1 are arranged close to each other in the Y-direction, the terminal electrodes belonging to the primary side and those belonging to the secondary side do not come so close to each other. Further, as illustrated in FIG. 8B, when the four pulse transformers 1A to 1D are arranged in a row in the Y-direction, it is possible to lead out all the wiring patterns belonging to the primary side to one side (e.g., left side) in the X-direction and to lead out all the wiring patterns belonging to the secondary side to the other side (e.g., right side) in the X-direction, thereby simplifying the routing of the wiring patterns. The pulse transformer 1 according to the present embodiment is suitable for use in such a layout.

Figure 9A:
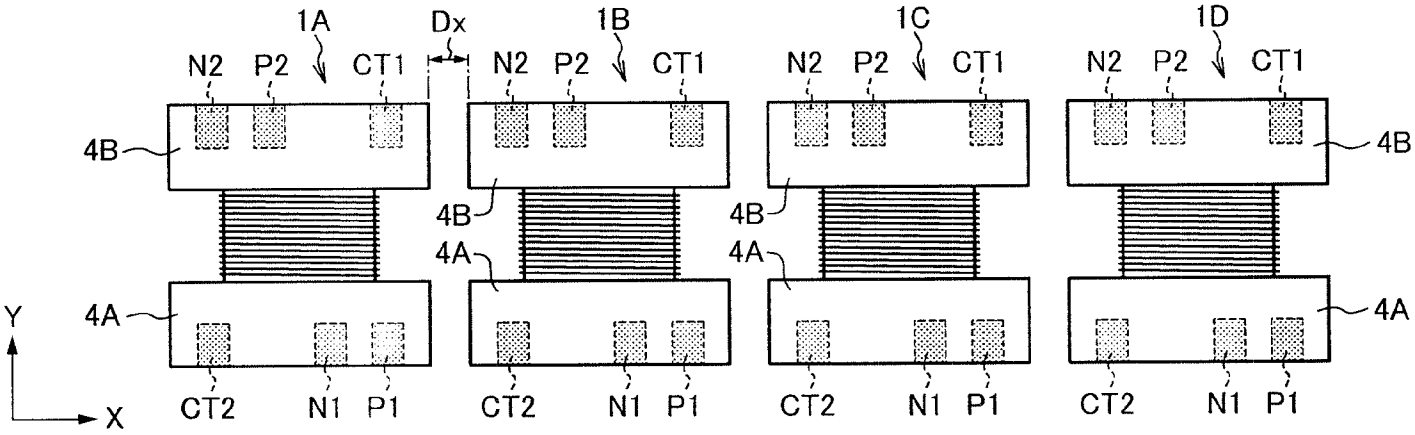
FIG. 9A is an exemplary plan view illustrating a state where the four pulse transformers 1A to 1D are arranged in a row in the X-direction.
Figure 9B:
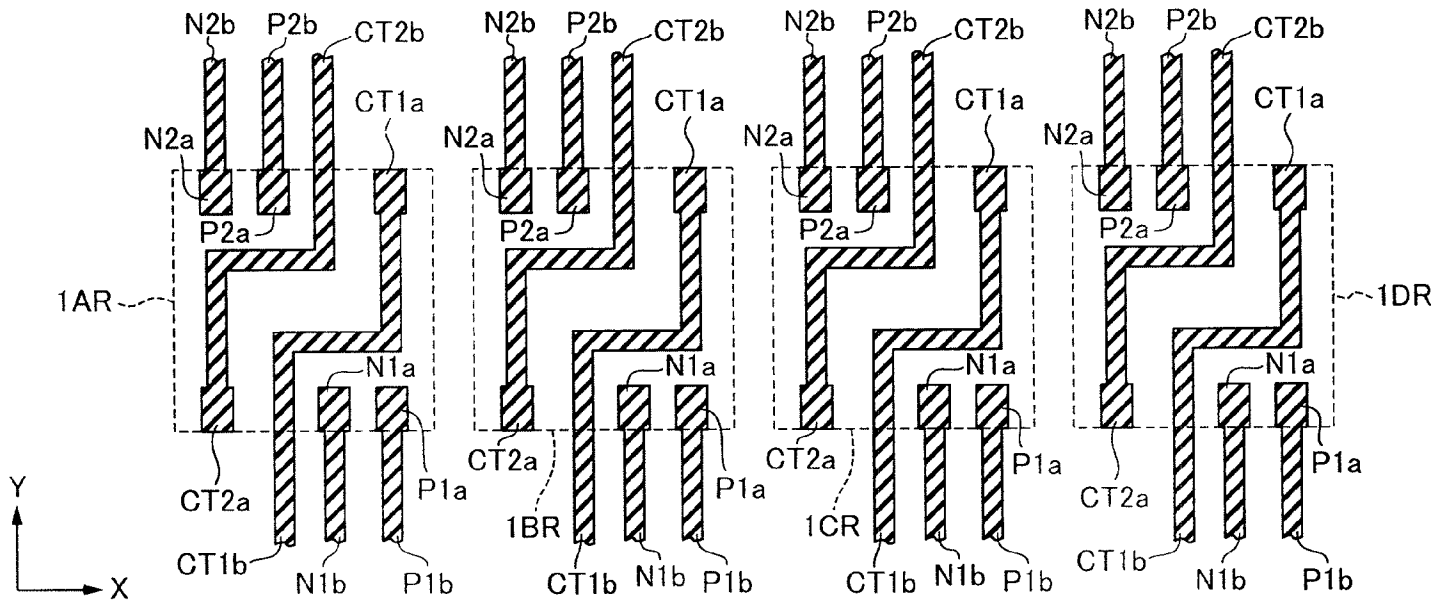
FIG. 9B is an exemplary plan view illustrating wiring patterns on the printed circuit board corresponding to the arrangement illustrated in FIG. 9A.

FIG. 9A is an exemplary plan view illustrating a state where the four pulse transformers 1A to 1D are arranged in a row in the X-direction, and FIG. 9B is an exemplary plan view illustrating wiring patterns on the printed circuit board corresponding to the arrangement illustrated in FIG. 9A.

As illustrated in FIG. 9A, when the four pulse transformers 1A to 1D are arranged in a row in the X-direction, it is necessary to ensure the distance Dx between the adjacent pulse transformers to some extent. That is, it is necessary to satisfy Dx>Dy. This is because when the two pulse transformers 1 are arranged close to each other in the X-direction, the terminal electrodes belonging to the primary side and those belonging to the secondary side come close to each other. Further, as illustrated in FIG. 9B, it is possible to lead out all the wiring patterns belonging to the primary side to one side (e.g., lower side) in the Y-direction and to lead out all the wiring patterns belonging to the secondary side to the other side (e.g., upper side) in the Y-direction, thereby simplifying the routing of the wiring patterns. The pulse transformer 1 according to the present embodiment is suitable for use in such a layout.

As described above, the pulse transformer 1 according to the present embodiment has a square shape in a plan view. Thus, it is possible to adopt various layouts while ensuring sufficient withstand voltage between the primary and secondary sides. This increases freedom of layout on the printed circuit board to thereby provide a suitable application of the pulse transformer of the present invention to a circuit component, such as a connector, that uses a plurality of pulse transformers.

Although the preferable embodiment of the invention has been described above, it is needless to say that the invention is by no means restricted to the embodiment and can be embodied in various modes within the scope which does not depart from the gist of the invention.

For example, the pulse transformer included in a scope of the present invention need not be a perfect square but may be substantially a square shape. This is because the drum core using a magnetic material such as ferrite is formed using a die, so that there inevitably occurs an error in production accuracy. When the drum core is formed using a die, a normal production accuracy is about ±50 μm. Considering this, when a difference between the X-direction length and Y-direction length of the drum core is equal to or less than 100 μm, it can be said that the pulse transformer has substantially a square shape. However, in order to obtain sufficient effect of the present invention, it is desirable to set the difference between the X-direction length and Y-direction length of the drum core equal to or less than 10% of the length in the X- and Y-directions.

Further, although a pulse transformer of a type in which the terminal fittings are adhered to the flange is exemplified in the above embodiment, the pulse transformer of the present invention is not limited to this type, but may be a type in which a conductive material such as silver paste is directly formed on the flange.

Figure 10:
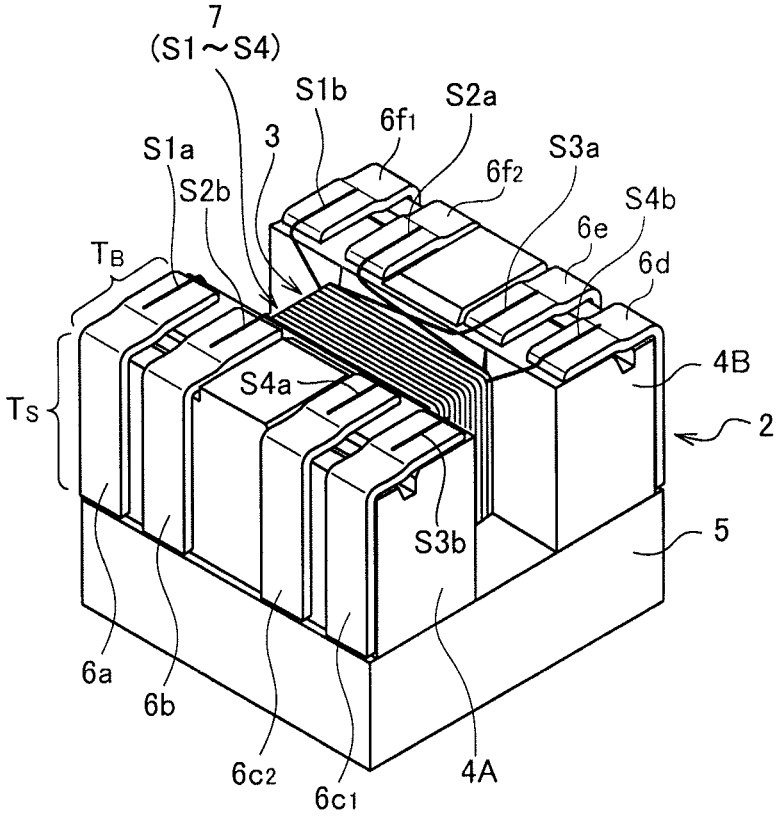
FIG. 10 is a schematic perspective view illustrating an outer appearance of a pulse transformer set with the top and bottom thereof reversed and viewed from the bottom side according to another preferred embodiment of the present invention.

Further, the pulse transformer 1 of a type in which three terminal fittings are fixed to each flange in the above embodiment; however, as illustrated in FIG. 10, a configuration may be adopted in which four terminal fitting are fixed to each flange. In the example illustrated in FIG. 10, the terminal fitting 6*c* is divided into two terminal fittings 6*c*1 and 6*c*2, and terminal fitting 6*f* is divided into two terminal fittings 6*f*1 and 6*f*2. In this case, the other end S3*b* of the wire S3 is connected to the terminal fitting 6*c*1 (or 6*c*2), the one end S4*a* of the wire S4 is connected to the terminal fitting 6*c*2 (or 6*c*1), the other end S1*b* of the wire S1 is connected to the terminal fitting 6*f*1 (or 6*f*2), and one end S2*a* of the wire S2 is connected to the terminal fitting 6*f*2 (or 6*f*1) (6*c*1→6*f*1). Then, the terminal fittings 6*f*1 and 6*f*2 are short-circuited to each other through the wiring pattern on the printed circuit board, and terminal fittings 6*c*1 and 6*c*2 are short-circuited to each other through the wiring pattern on the printed circuit board, whereby substantially the same function as that obtained by the pulse transformers 1 illustrated in FIGS. 1 to 3 can be achieved. Thus, the pulse transformer having such a configuration is included in the scope of the present invention.

What is claimed is:

1. A pulse transformer, comprising:

a core, including a drum core and a plate core, the drum core having a winding core, a first flange provided at one end of the winding core in a first direction, and a second flange provided at the other end of the winding core in the first direction, the plate core being provided so as to contact the first flange and the second flange;

a first terminal electrode, a second terminal electrode, and a second center tap which are provided in the first flange and arranged in a second direction perpendicular to the first direction;

a third terminal electrode, a fourth terminal electrode, and a first center tap which are provided in the second flange and arranged in the second direction;

a first wire wound around the winding core and having one end connected to the first terminal electrode and the other end connected to the first center tap;

a second wire wound around the winding core and having one end connected to the second terminal electrode and the other end connected to the first center tap;

a third wire wound around the winding core and having one end connected to the third terminal electrode and the other end connected to the second center tap; and a fourth wire wound around the winding core and having one end connected to the fourth terminal electrode and the other end connected to the second center tap, wherein a length of the core in the first direction and a length of the core in the second direction are substantially equal to each other, such that a planar shape of a mounting region of the pulse transformer is substantially square, wherein a length of the core in a third direction perpendicular to the first and second directions is smaller than the length of the core in the first and second directions, wherein the first to fourth terminal electrodes and first and second center taps are each formed as a terminal fitting fixed to the first or second flange, and wherein each of the first flange and the second flange has a first surface extending in the first and second directions, and a second surface extending in the second and third directions, the first surface has a lower area and an upper area protruding from the lower area, and each of the terminal fittings has a first section covering the upper area of the first surface, a second section covering the lower area of the first surface, and a third section covering the second surface.

2. The pulse transformer as claimed in claim 1, wherein the second center tap includes first and second center tap terminal electrodes provided in the first flange, and the first center tap includes third and fourth center tap terminal electrodes provided in the second flange.

3. The pulse transformer as claimed in claim 2, wherein the first wire connects the first terminal electrode and third center tap terminal electrode, the second wire connects the second terminal electrode and fourth center tap terminal electrode, the third wire connects the third terminal electrode and first center tap terminal electrode, and fourth wire connects the second terminal electrode and second center tap terminal electrode.

4. The pulse transformer as claimed in claim 1, wherein each of the terminal fittings is bent in a position between the first and second sections.

5. The pulse transformer as claimed in claim 4, wherein each of the terminal fittings is in contact with an associated one of the first to fourth wires at the first section without being in contact as the second section.

6. The pulse transformer as claimed in claim 5, wherein each of the first to fourth wires is terminated on the position between the first and second sections.

* * * * *